US005287569A

United States Patent [19]

Johnson

[11] Patent Number: 5,287,569

[45] Date of Patent: Feb. 22, 1994

[54] PORTABLE SHOWER APPARATUS

[76] Inventor: Wayne G. Johnson, 180 Clarke Rd., Vicksburg, Miss. 39180

[21] Appl. No.: 973,658

[22] Filed: Nov. 9, 1992

[51] Int. Cl.[5] ..... A47K 3/23

[52] U.S. Cl. ..... 4/599; 4/603

[58] Field of Search ..... 4/526, 527, 596, 599, 4/601, 602, 603, 612, 613, 614, 615, 616, 617

[56] References Cited

U.S. PATENT DOCUMENTS

| | | | |
|---|---|---|---|
| 2,336,402 | 12/1943 | Kaiser | 4/601 |
| 2,778,031 | 1/1957 | Logan | 4/601 |
| 3,293,664 | 12/1966 | Coons | 4/599 |
| 3,681,788 | 8/1972 | Le Blanc et al. | 4/602 |
| 3,925,828 | 12/1975 | Kim | 4/599 |
| 5,073,996 | 12/1991 | Schinle | 4/601 |

FOREIGN PATENT DOCUMENTS

| | | | |
|---|---|---|---|
| 0715301 | 9/1954 | United Kingdom | 4/602 |

*Primary Examiner*—Robert M. Fetsuga
*Attorney, Agent, or Firm*—Leon Gilden

[57] ABSTRACT

A portable shower includes a rectilinear framework of a generally parallelepiped construction, having a flexible shower curtain securable thereabout, as well as an underlying floor shield and floor plate structure. The shower apparatus includes a heating assembly arranged to include a reservoir having a heating source effecting heating of fluid within the reservoir and an electric pump to direct fluid through the rectilinear framework to an overlying shower head.

5 Claims, 4 Drawing Sheets

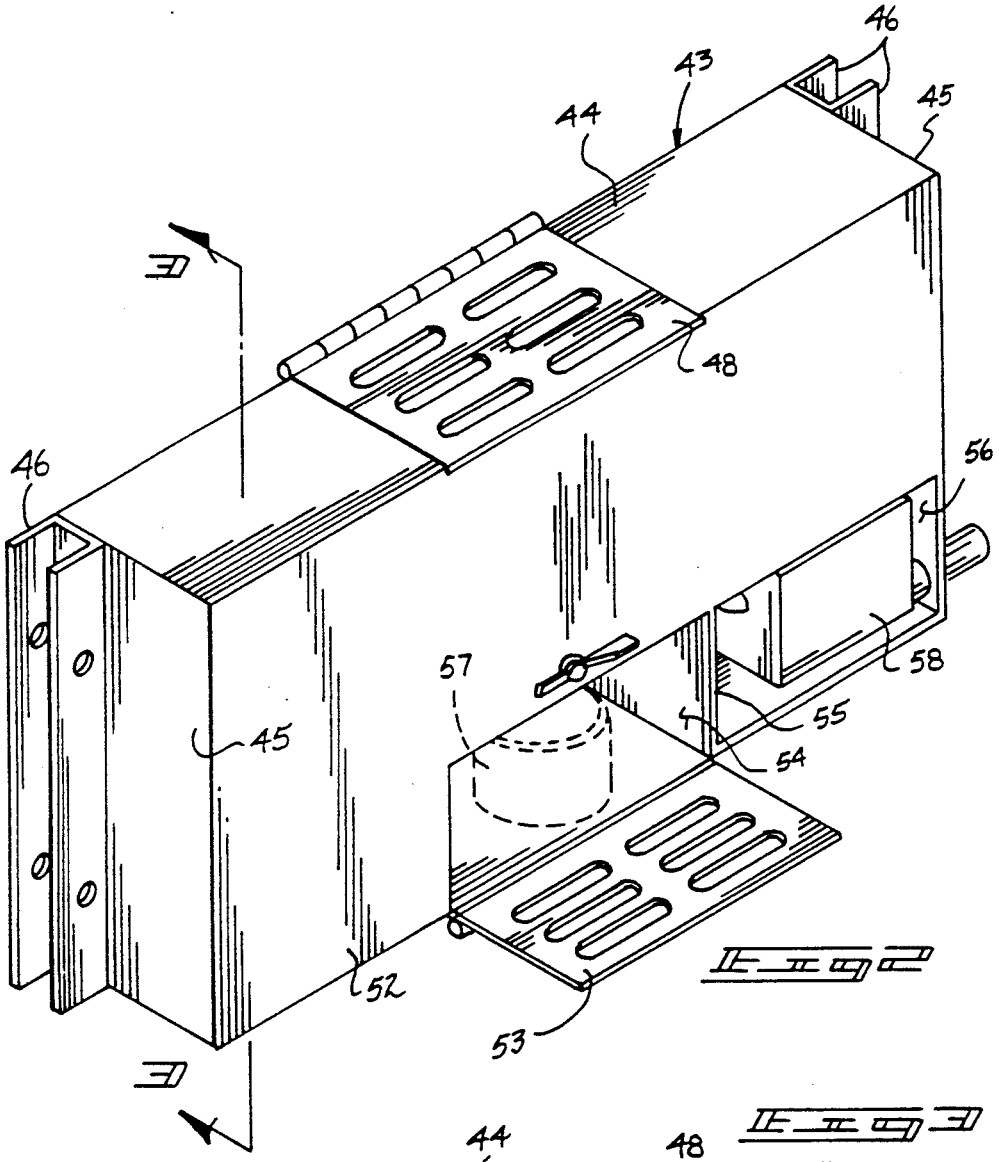
FIG 2
FIG 3
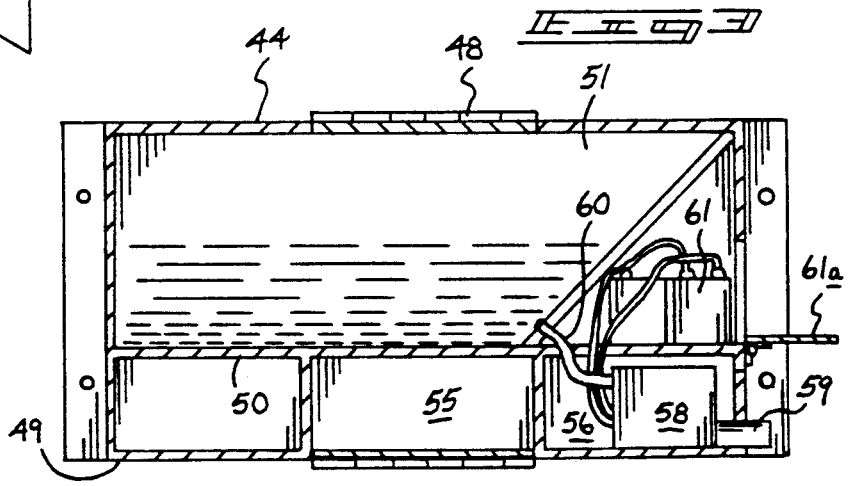

PORTABLE SHOWER APPARATUS

BACKGROUND OF THE INVENTION

1. Field of the Invention

The field of invention relates to portable shower apparatus, and more particularly pertains to a new and improved portable shower apparatus wherein the same is arranged to provide for a self-contained heating organization and pump structure.

2. Description of the Prior Art

Portable showers of various types have been utilized throughout the prior art and such shower apparatus is exemplified in the U.S. Pat. Nos. 4,975,992; 4,809,369; 4,170,795; 4,866,794; and 4,453,280.

The prior art has heretofore failed to direct the use of a self-contained heating and pump structure, as well as illumination in a manner as indicated by the instant invention and in this respect, the present invention substantially fulfills this need.

SUMMARY OF THE INVENTION

In view of the foregoing disadvantages inherent in the known types of portable shower apparatus now present in the prior art, the present invention provides a portable shower apparatus wherein the same utilizes a pump housing arranged to direct fluid from a reservoir housing containing the pump housing for directing fluid through the rectilinear framework to a shower head overlying the rectilinear framework. As such, the general purpose of the present invention, which will be described subsequently in greater detail, is to provide a new and improved portable shower apparatus which has all the advantages of the prior art portable shower apparatus and none of the disadvantages.

To attain this, the present invention provides a portable shower including a rectilinear framework of a generally parallelepiped construction, having a flexible shower curtain securable thereabout, as well as an underlying floor shield and floor plate structure. The shower apparatus includes a heating assembly arranged to include a reservoir having a heating source effecting heating of fluid within the reservoir and an electric pump to direct fluid through the rectilinear framework to an overlying shower head.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable shower apparatus which has all the advantages of the prior art portable shower apparatus and none of the disadvantages.

It is another object of the present invention to provide a new and improved portable shower apparatus which may be easily and efficiently manufactured and marketed.

It is a further object of the present invention to provide a new and improved portable shower apparatus which is of a durable and reliable construction.

An even further object of the present invention is to provide a new and improved portable shower apparatus which is susceptible of a low cost of manufacture with regard to both materials and labor, and which accordingly is then susceptible of low prices of sale to the consuming public, thereby making such portable shower apparatus economically available to the buying public.

Still yet another object of the present invention is to provide a new and improved portable shower apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an isometric illustration of the reservoir housing of the invention.

FIG. 3 is an orthographic view, taken along the lines 3—3 of FIG. 2 in the direction indicated by the arrows.

DESCRIPTION OF THE PREFERRED EMBODIMENT

Figure 1:
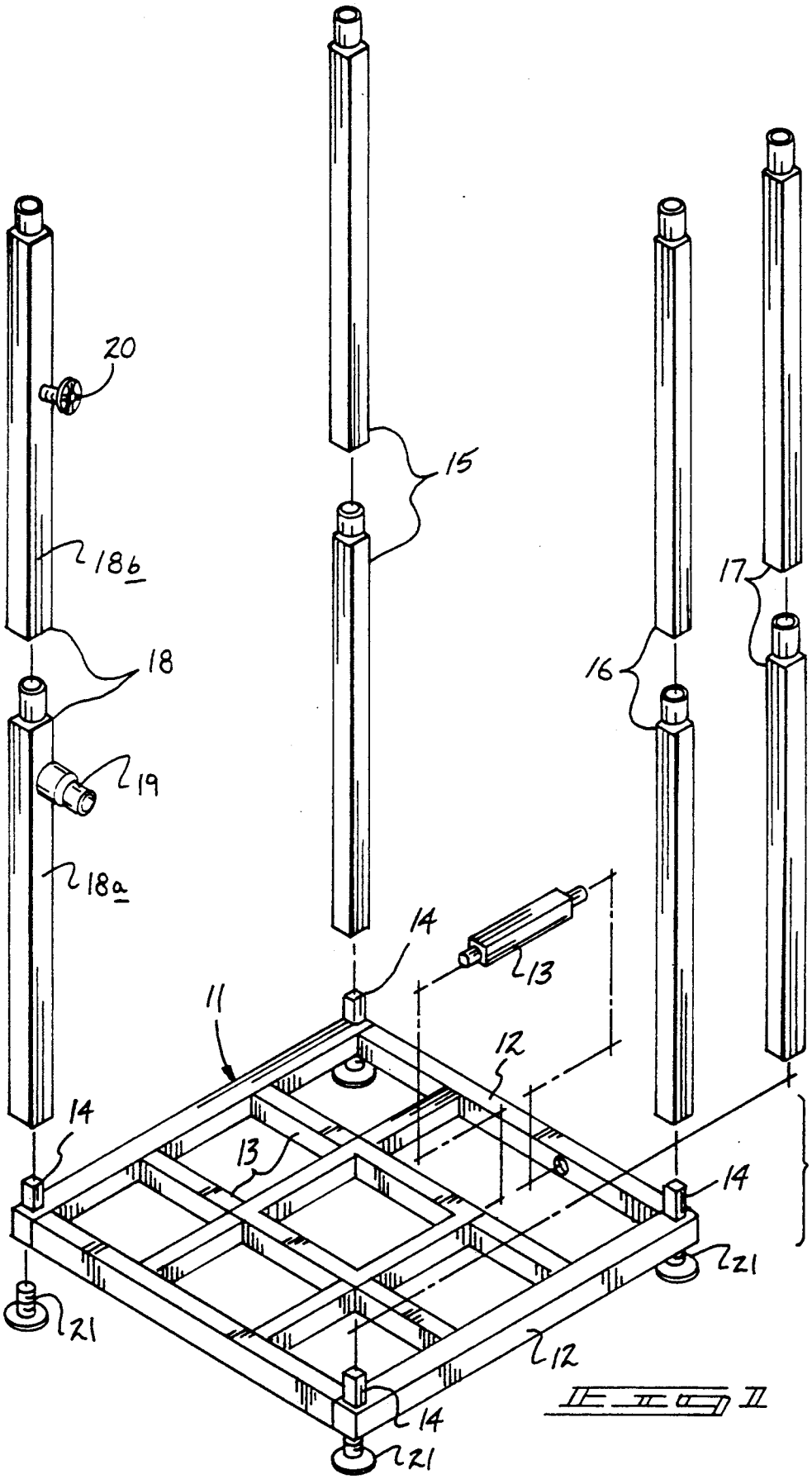
FIG. 1 is an isometric illustration in an exploded view of the lowermost portion of the rectilinear framework.

With reference now to the drawings, and in particular to FIGS. 1 to 7 thereof, a new and improved portable shower apparatus embodying the principles and concepts of the present invention and generally designated by the reference numeral 10 will be described.

More specifically, the portable shower apparatus 10 of the instant invention essentially comprises a rectilinear base 11 having outer frame legs 12 separately connected relative to one another and to inner frame legs 13 to provide for the rectilinear base 11, with a support lug 14 mounted at each corner of the base 11 projecting orthogonally upwardly relative to the base 11, with each lug arranged for mounting a plurality of post members, to include first, second, third, and fourth post members 15, 16, 17, and 18 securable together. The fourth post members 18 include at least a first and second tubular post 18*a* and 18*b*. The first tubular post 18*a* includes a first conduit therethrough, with the second tubular post 18*b* having a second conduit therethrough in fluid communication with the first conduit. A connector conduit 19 is directed into the first conduit 18*a* for directing water therethrough, in a manner to be described in more detail below. A valve 20 is mounted to the second post 18*b* in operative communication with the second conduit to selectively direct fluid flow therethrough. Further, a support foot 21 is mounted to each corner of the base 11 below an associated lug 14. The support feet 21 are adjustably mounted to provide for leveling of the organization as required. A fabric ground shield container 22 to insulate the organization from depressed temperatures is provided and is arranged to receive the base 11. The ground shield container 22 includes a floor 23 having a drain opening 24 therethrough, as well as container wall 25 securable to a lower perimeter of enclosure walls 30 when the post members 15–18 have been assembled in container 22 by means of a zipper 26 directed along the upper edge of each container wall 25 to secure the walls together in a continuous manner, as indicated in FIG. 7 for example.

A rigid apertured floor plate 27 is arranged for positioning upon the base 11, with the floor plate 27 arranged to receive a porous flexible mat 28 thereon to provide for a non-slip surface for an individual. Further, each of the post members 15 at the upper distal ends includes a hook 33. Further, a fabric enclosure 29 is provided, having enclosure walls 30, wherein the walls have a predetermined height substantially equal to a post height of each of the post members 15–18 in an assembled configuration. The enclosure's zipper 31 as provided and indicated in FIG. 7 is directed along one of the walls 30 for access readily into and out of the enclosure structure. Further, each intersection of the walls 30 includes a wall support ring 32 at the upper distal end of the enclosure, with each wall support ring 32 arranged for mounting upon a hook member 33 for positioning the enclosure on the rectilinear framework assembly, as indicated in FIG. 7.

Figure 4:
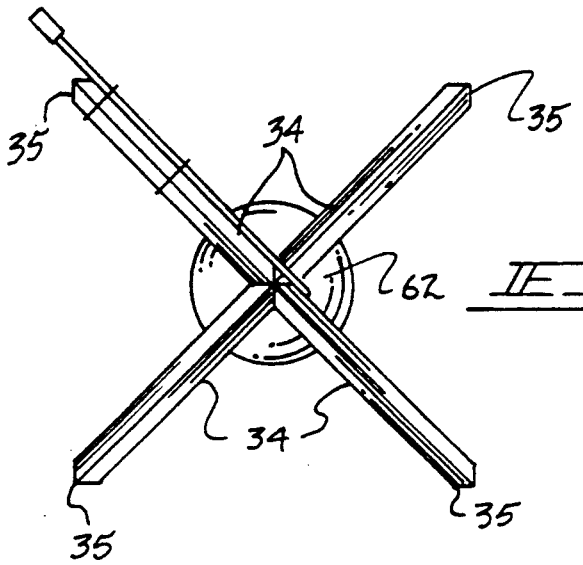
FIG. 4 is an orthographic top view of the roof assembly structure of the invention.
Figure 5:
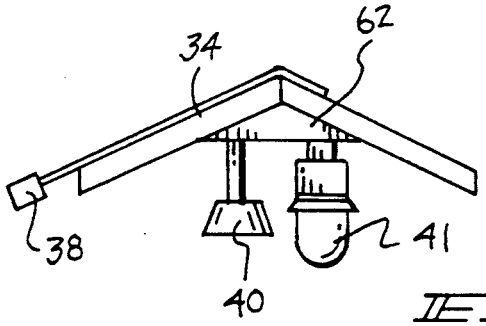
FIG. 5 is an orthographic side view, as set forth in FIG. 4.
Figure 6:
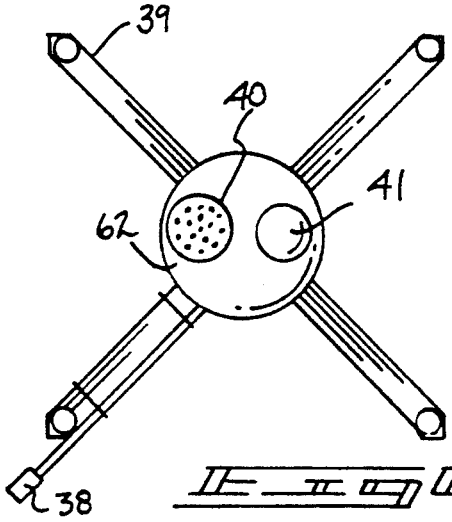
FIG. 6 is an orthographic bottom view of the assembly as set forth in FIG. 4.

The roof assembly, as indicated in the FIGS. 4–6, having roof braces 34 intersecting at a predetermine intersection, with each of the roof braces 34 canted downwardly relative to the intersection, with the intersection having a mounting plate 62 secured to the intersection onto the roof braces 34. Each of the roof braces 34 includes a lowermost end 35 arranged for mounting to an uppermost end of one of the post members 15–18. One of the roof braces, as indicated in FIG. 6 for example, includes a roof brace conduit 39 directed therethrough in fluid communication and securement to a projecting conduit 36 projecting from the fourth post members 18 in communication with the first and second conduits of the first and second tubular posts 18*a* and 18*b*. An illumination bulb 41 mounted and secured to the mounting plate 62 includes a second electrical connector 38 for securement to a first electrical connector 37 mounted to the fourth post members 18 (see FIG. 7).

Figure 7:
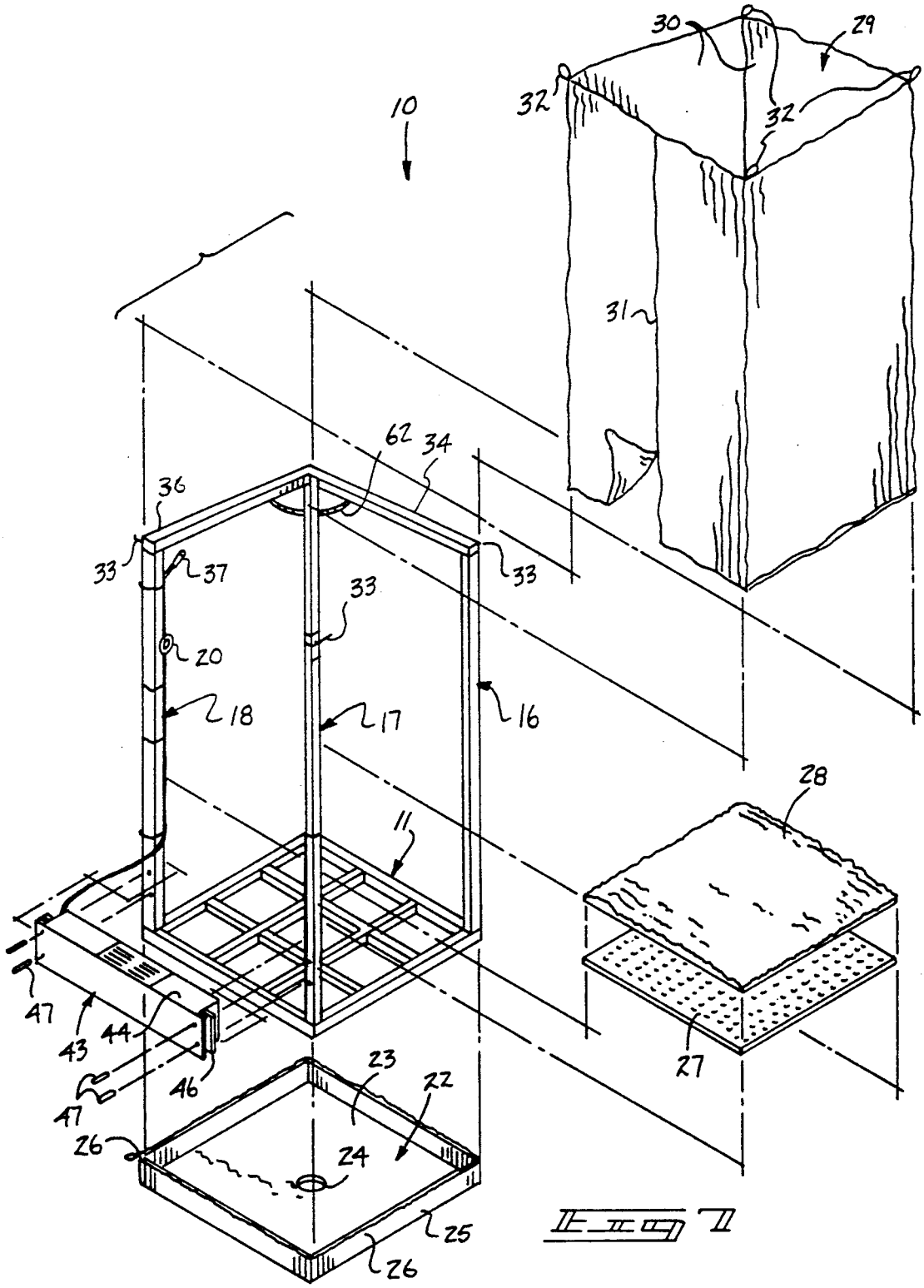
FIG. 7 is an isometric illustration in an exploded view of the shower apparatus of the invention.

A reservoir housing 43 is provided (see FIGS. 7 and 2), wherein the reservoir housing includes a housing top wall spaced from a housing first floor 49, with housing side walls 45, each of the side walls 45 having at least one flange 46, wherein each of the flanges 46 is arranged to receive fasteners 47 directed through the flanges and into the fourth post members 18 and the third post members 17, as indicated in FIG. 7, to secure the reservoir housing relative to the rectilinear framework. A top wall lid 48 is directed through the reservoir housing top wall 44 for access to a fluid reservoir cavity 51 to direct fluid therein, with the reservoir cavity 51 oriented between a second floor 50 positioned above the first floor 49 and the top wall 44. A reservoir front wall 52 includes a front wall door plate 53 permitting access to a heating chamber 54 between the first and second floors 49 and 50 to position heating means 57, such as STERNO (TM) within the heating chamber 54. A pump chamber 56 is positioned in adjacency to the heating chamber 54 insulated therefrom by a partition wall 55. The pump chamber 56 includes a fluid pump 58 therewithin having an outlet conduit 59 directed therefrom for fluid communication with the connector conduit 19 of the first tubular post 18*a*. An inlet conduit 60 is directed from the fluid reservoir cavity 51 in adjacency to the second floor 50 to the fluid pump. Battery members 61 mounted in adjacency to the pump 58 permit selective operation of the pump, with the batteries accessed through a battery door 61*a* directed through one of the side walls, as indicated in FIG. 3.

In this manner, upon heating of water within the reservoir cavity, the water upon actuation of the pump 58 is directed through the outlet conduit 59 and subsequently through the first and second conduits of the first and second tubular posts 18*a* and 18*b* and through the roof brace conduit 39 into the shower head 40. Optional equipment for the organization may include a thermostat in operative communication with the pump to effect actuation of the pump upon predetermined heating of water within the reservoir cavity 51, as well as a thermometer in operative communication with the water within the cavity as optional usage of the organization. Further, in lieu of the batteries 61, an adapter to permit utilization of the fluid pump (a twelve volt pump typically) to a vehicular cigarette lighter utilizing a conventionally known cigarette lighter plug may be employed to effect operation of the fluid pump 58.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable shower apparatus, comprising, a framework having a base, with the base having base openings directed therethrough, and the framework further including a plurality of first post members, a plurality of second post members, a plurality of third post members, and a plurality of fourth post members, with the fourth post members including a first tubular post and a second tubular post, the first tubular post having a first conduit directed therethrough, the second tubular post having a second conduit directed therethrough, with the first and second conduits arranged for fluid communication relative to one another, and a connector conduit directed into the first conduit, and a roof assembly mounted to the post members, the roof assembly including a plurality of roof braces joined at an intersection, with the intersection having a mounting plate thereon, the mounting plate including a shower head, and one of said roof braces including a roof brace conduit in fluid communication with the second conduit, and the roof brace conduit being in fluid communication with the shower head, and fluid supply means mounted to the fourth post members and the third post members for directing fluid into the second tubular post through the connector conduit, and a flexible ground shield container positioned below the base, with the ground shield container having a container floor, the container floor having a drain opening directed therethrough, and the container further including container walls, the container walls each having a wall upper distal end, and each wall upper distal end includes a zipper means, wherein the zipper means of each container wall is arranged for selective securement relative to one another for securing the container walls together to receive the rectilinear base therewithin.

2. An apparatus as set forth in claim 1 wherein the first, second, third, and fourth post members each includes a hook member, and further including a flexible enclosure, the enclosure including enclosure walls, and each of the enclosure walls includes at least one ring member, and each ring member is arranged for securement to at least one hook, and at least one of the walls includes a zipper directed coextensively therethrough for permitting access into the enclosure.

3. An apparatus as set forth in claim 2 wherein the mounting plate further includes an illumination bulb, and the illumination bulb having an electrical conduit, the electrical conduit terminating in a second electrical connector, and a first electrical connector positioned adjacent the roof assembly for securement to the second electrical connector, and the first electrical connector connected along the fourth post members in electrical communication with the fluid supply means.

4. An apparatus as set forth in claim 3 wherein the fluid supply means includes a reservoir housing, the housing having a top wall spaced from a first floor, a first side wall spaced from a second side wall, the first side wall includes first flanges, the second side wall includes second flanges, and the first flanges include first fasteners to secure the first flanges to the third post members, and the second fasteners are directed through the second flanges to secure the second flanges to the fourth post members, and the reservoir housing further including a second floor within the housing spaced above the first floor, and a fluid reservoir cavity oriented between the second floor and the top wall, the top wall having a top wall lid for directing fluid into the reservoir cavity through the top wall, and the housing having a front wall, the front wall including a door plate, the door plate positioned in adjacency to a heating chamber between the first floor and the second floor, the heating chamber having heating means positionable therewithin for heating of fluid within the fluid reservoir cavity, and a pump chamber in adjacency to the heating chamber, and a partition wall in an interface between the pump chamber and the heating chamber, and pump means contained within the pump chamber for directing fluid from the fluid reservoir cavity to the connector conduit.

5. An apparatus as set forth in claim 4 wherein the pump means includes a fluid pump, and the floor pump having an outlet conduit in fluid communication between the fluid pump and the connector conduit, and the fluid pump further including an inlet conduit directed through between the fluid pump into the fluid reservoir cavity in adjacency to the second floor, and at least one battery member arranged for selective actuation of the fluid pump and for directing electrical current to the illumination bulb through the first electrical connector and the second electrical connector.

* * * * *